US011138957B2

(12) United States Patent
Arai et al.

(10) Patent No.: US 11,138,957 B2
(45) Date of Patent: Oct. 5, 2021

(54) ENDPIN MAIN BODY FIXING MEMBER AND FIXING TOOL, AND MUSICAL INSTRUMENT EQUIPPED WITH FIXING TOOL

(71) Applicants: Yoshitomo Arai, Koka (JP); Yoshiyuki Arai, Koka (JP)

(72) Inventors: Yoshitomo Arai, Koka (JP); Yoshiyuki Arai, Koka (JP)

( * ) Notice: Subject to any disclaimer, the term of this patent is extended or adjusted under 35 U.S.C. 154(b) by 0 days.

(21) Appl. No.: 17/256,538

(22) PCT Filed: Oct. 21, 2019

(86) PCT No.: PCT/JP2019/041356
§ 371 (c)(1),
(2) Date: Dec. 28, 2020

(87) PCT Pub. No.: WO2020/085320
PCT Pub. Date: Apr. 30, 2020

(65) Prior Publication Data

US 2021/0256942 A1 Aug. 19, 2021

(30) Foreign Application Priority Data

Oct. 23, 2018 (JP) ..... JP2018-199005

(51) Int. Cl.
*G10D 3/01* (2020.01)
*G10D 1/02* (2006.01)

(52) U.S. Cl.
CPC ..... *G10D 3/01* (2020.02); *G10D 1/02* (2013.01)

(58) Field of Classification Search
CPC ..... G10D 3/01; G10D 1/02; G10D 3/00
See application file for complete search history.

(56) References Cited

U.S. PATENT DOCUMENTS

2005/0235806 A1 10/2005 Alberti
2021/0035538 A1* 2/2021 Wang ..... G10D 3/01

FOREIGN PATENT DOCUMENTS

CN 101141900 A 3/2008
DE 1772538 A1 5/1971
(Continued)

OTHER PUBLICATIONS

Office Action of the corresponding Japanese Application 2018-199005, dated Mar. 1, 2019, 14 pp.
(Continued)

*Primary Examiner* — Kimberly R Lockett
(74) *Attorney, Agent, or Firm* — United IP Counselors, LLC

(57) ABSTRACT

A main body fixing member is disclosed. The main body fixing member fixes an endpin including a shaft portion having a first end housed in a musical instrument main body and a second end stood on a floor. The shaft portion is provided with a recess. The main body fixing member includes a fitting portion, a through hole through which the shaft portion of the endpin extends, an opening disposed orthogonal to the through hole and having a bottom surface, a columnar member, a biasing portion, and a pressing portion. The columnar member is provided with a hole through which the shaft portion extends, and an engagement protrusion engaged with the recess of the shaft portion. The engagement protrusion is formed on an inner surface of the hole. The pressing portion presses the shaft portion inserted into the through hole and the hole via the columnar member.

10 Claims, 9 Drawing Sheets

(56) References Cited

FOREIGN PATENT DOCUMENTS

| | | | |
|---|---|---|---|
| JP | 02-004784 | U | 1/1990 |
| JP | 03-051005 | A | 3/1991 |
| JP | 2000-200082 | A | 7/2000 |
| JP | 2001-215953 | A | 8/2001 |
| JP | 2008-531176 | A | 8/2008 |
| JP | 2013-048651 | A | 3/2013 |
| JP | 6142972 | B | 6/2017 |
| WO | 2006/101279 | A1 | 9/2006 |

OTHER PUBLICATIONS

International Search Report for International Application No. PCT/JP2019/041356, dated Dec. 17, 2019, 5 pp.
Written Opinion of International Application No. PCT/JP2019/041356, dated Dec. 17, 2019, 4 pp.
Amazon "Contrabass carbon endpin diameter 10mm", Aug. 22, 2016, searched on Feb. 27, 2019.
Office Action dated May 15, 2019 issued in Japanese patent application No. 2018-199005.
Notice of Allowance dated Jul. 19, 2019 mailed in JP patent application No. 2018-199005.

* cited by examiner

FIG. 5A
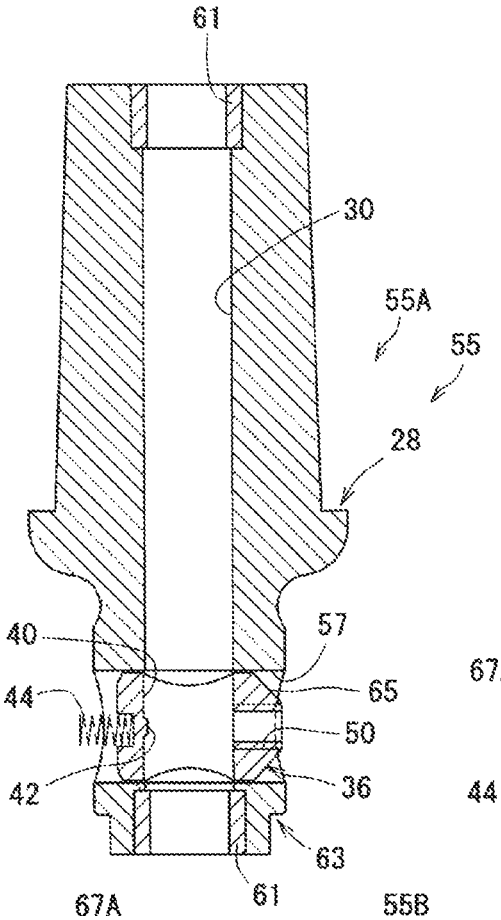
FIG. 5C
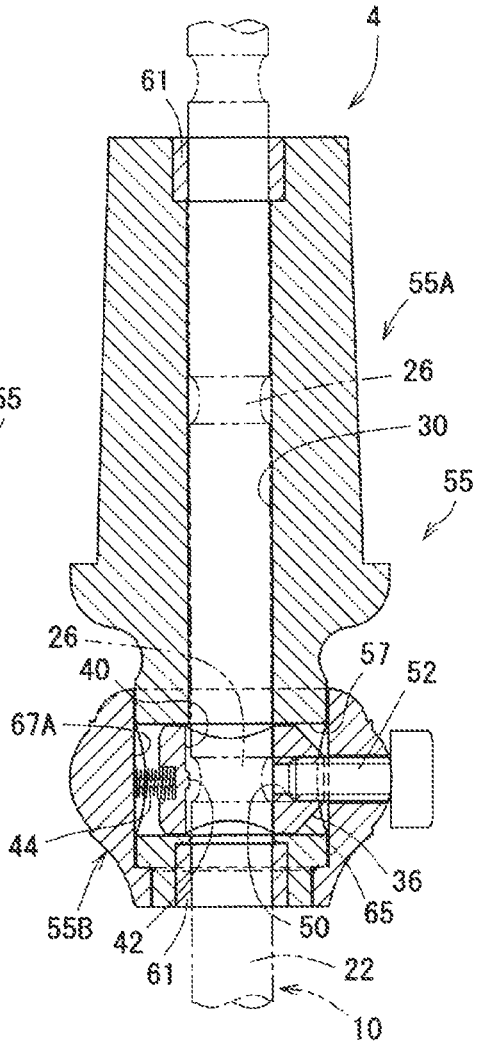
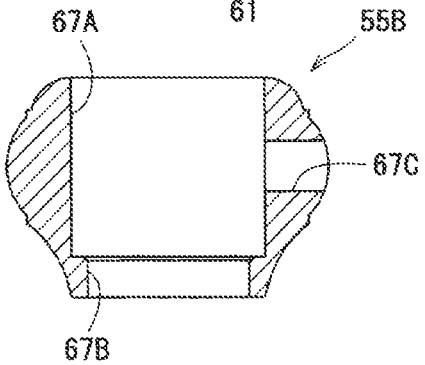
FIG. 5B

ENDPIN MAIN BODY FIXING MEMBER AND FIXING TOOL, AND MUSICAL INSTRUMENT EQUIPPED WITH FIXING TOOL

CROSS-REFERENCE TO RELATED APPLICATIONS

This application is the U.S. National Phase of International Application No. PCT/JP2019/041356, filed on Oct. 21, 2019. This application claims priority to Japanese Patent Application No. 2018-199005, filed Oct. 23, 2018. The entire contents of those applications are incorporated by reference herein in their entireties.

TECHNICAL FIELD

The present invention relates to a main body fixing member and a fixing tool for an endpin used in a large musical instrument, and a musical instrument including the fixing tool.

BACKGROUND ART

Endpins are used for large musical instruments such as stringed instruments such as a contrabass and a cello and woodwind instruments such as a bass clarinet. For example, in a case of the contrabass, as illustrated in FIG. 7, an endpin 100 or 102 is a metal rod-shaped member that is stood on a floor 103 to support a musical instrument, and is detachably attached to a lower end portion (tail portion) 114 of the large musical instrument. The endpin 100 or 102 is an important part having a role of transmitting vibration (sound) to the floor and amplifying resonance, in addition to the role of supporting the musical instrument. The endpin 100 or 102 needs to be adjusted in length according to a height (sitting height), a performing style, or the like of a performer, and is therefore fixed by a fixing tool in an extendable and contractible manner.

There are two types of length-adjustable fixing tools for an endpin that have been conventionally provided. As illustrated in FIGS. 8 and 9, each of the length-adjustable fixing tools includes the endpin 100 or 102 and a main body fixing member 104 or 106. In the endpin 100 or 102, one end of a shaft portion 108 or 110 is housed in the lower end portion 114 of a musical instrument main body, and the other end includes a pointed tip portion 112 for standing the musical instrument on the floor. The tip portion 112 is provided with a rubber cap 113 for the purpose of protecting a floor surface and the like. The main body fixing member 104 or 106 includes a through hole 116 through which the shaft portion 108 or 110 of the endpin 100 or 102 is passed, a fastener 118 or 120 that fastens the shaft portion 108 or 110 of the endpin 100 or 102 at a desired position, and a musical instrument fixing portion 122 that is detachably fixed to the lower end portion 114 of the musical instrument main body.

Specifically, in one of the fixing tools, as illustrated in FIG. 8, annular recesses 124 are formed in the shaft portion 108 of the endpin 100 at equal intervals in an axial direction. The fastener 118 of the main body fixing member 104 includes a female screw 126 formed in a direction perpendicular to the through hole 116 and a male screw member 128 that is screwed to the female screw 126. A tip portion of the male screw member 128 is fitted into the annular recess 124 formed in the shaft portion 108, so that the endpin 100 and the main body fixing member 104 are firmly fixed.

However, the work of fitting the tip portion of the male screw member 128 into the annular recess 124 of the endpin 100 has to be dependent on the sense because the main body fixing member 104 is made of wood or the like and the annular recess 124 cannot be seen. Therefore, assuming that the tip portion of the male screw member 128 is fitted in the annular recess 124 of the endpin 100, there has been a problem that if the tip portion of the male screw member 128 hits a portion other than the annular recess 124 when the musical instrument is being performed on, slightly loosening the male screw member 128 due to vibration or the like causes the endpin 100 to be gradually slipped and to enter the inside of the musical instrument.

Furthermore, in the other of the fixing tools, as illustrated in FIG. 9, the endpin 102 includes the straight shaft portion 110 having no annular recess. The fastener 120 of the main body fixing member 106 includes a slide member 134 including a male screw 132 formed at one end of a columnar member 130, a cap 136 that covers an insertion port of the columnar member 130, which is opened on a side surface of the main body fixing member 106, and includes, in the center of the cap 136, a hole into which the male screw 132 is inserted, and a female screw member 138 including a female screw that is screwed to the male screw 132 protruding from the hole in the cap 136. In the columnar member 130 of the slide member 134, a hole 140 having the same diameter as the through hole 116 is opened at a position crossing the through hole 116 that is opened in the main body fixing member 106 and through which the shaft portion 110 of the endpin 102 is passed. With this structure, the shaft portion 110 of the endpin 102, which is passed through the through hole 116 of the main body fixing member 106 and the hole 140 of the columnar member 130, is fixed by a frictional force generated by positions of the through hole 116 and the hole 140 being relatively displaced when the female screw member 138 is tightened.

This fixing tool can fix the endpin 102 at any position, and the length of the endpin 102 can be easily adjusted. However, there is a problem that when a tightening force of the female screw member 138 is weak, the ductility of the male screw 132 is also added and the frictional force is weakened, the shaft portion 110 of the endpin 102 slips and enters the inside of the musical instrument.

Regarding such fixing tools, a fixing tool for an endpin as shown in Japanese Patent No. 6142972 has been proposed. This fixing tool includes a first member attached to a musical instrument and a second member provided with a cutout to reduce a diameter, and inserts the second member into the first member having an inclined surface to reduce the diameter of the second member, so that an endpin is crimped and fixed by the second member. In this fixing tool, when the engagement between the first member and the second member is loosened, the endpin cannot be crimped, and the endpin enters the inside of the musical instrument.

A performance of a musical instrument at a concert or the like is performed in front of a large number of spectators, and thus, even if a fixing position of an endpin is displaced during the performance, there is no choice but to perform as it is. Therefore, performers have wanted a reliable fixing tool for an endpin that does not change the fixing position of the endpin unintentionally.

Also, an end pin for a musical instrument has been proposed in Japanese Patent Application Publication No. 2001-215953.

BRIEF SUMMARY

In view of the above-described problems, an object of the present invention is to make it possible to confirm that an endpin can be reliably fixed at a desired position when the endpin is fixed at the desired position by use of a fixing tool.

Furthermore, an object of the present invention is to provide such a fixing tool that, once the endpin is fixed at the desired position, the fixing position is not changed by displacement of the endpin even if a screw or the like of the fixing tool is loosened somewhat.

A main body fixing member according to the present invention is a main body fixing member that fixes an endpin including a shaft portion having one end housed in a musical instrument main body and another end stood on a floor, the shaft portion being provided with a recess. The main body fixing member includes a fitting portion that is fixed to the musical instrument main body, a through hole through which the shaft portion of the endpin extends, an opening that is provided on a side surface of the main body fixing member so as to be orthogonal to the through hole, and has a bottom surface, a columnar member that is slidably disposed in the opening, and is provided with a hole through which the shaft portion extends and an engagement protrusion that is engaged with the recess of the shaft portion, the engagement protrusion being formed on an inner surface of the hole, a biasing portion that is disposed between the bottom surface of the opening and an end surface of the columnar member, and a pressing portion that is provided on another end surface of the columnar member, and presses the shaft portion inserted into the through hole and the hole via the columnar member.

Furthermore, the main body fixing member according to the present invention is a main body fixing member that fixes an endpin including a shaft portion having one end housed in a musical instrument main body and another end stood on a floor, the shaft portion being provided with a recess. The main body fixing member includes a fitting portion that is fixed to the musical instrument main body, a through hole through which the shaft portion of the endpin extends, a lateral through hole that is provided on a side surface of the main body fixing member so as to be orthogonal to the through hole, a columnar member that is slidably disposed in the lateral through hole, and is provided with a hole through which the shaft portion extends and an engagement protrusion that is engaged with the recess of the shaft portion, the engagement protrusion being formed on an inner surface of the hole, a cover member that covers the lateral through hole, a biasing portion that is disposed between an inner surface of the cover member and an end surface of the columnar member, and a pressing portion that is provided on another end surface of the columnar member, and presses the shaft portion inserted into the through hole and the hole via the columnar member.

Furthermore, the main body fixing member according to the present invention is a main body fixing member that fixes an endpin including a shaft portion having one end housed in a musical instrument main body and another end stood on a floor, the shaft portion being provided with a recess. The main body fixing member includes a fitting portion that is fixed to the musical instrument main body, a through hole through which the shaft portion of the endpin extends, a female screw that is provided on a side surface of the main body fixing member so as to reach the through hole, an engagement portion that has a U-shaped cross section and is inserted into the female screw, a pressing portion that is screwed to the female screw and abuts against an end surface of the engagement portion to press the shaft portion via the engagement portion, and a biasing portion in which one end is housed in an opening provided in the engagement portion having U-shaped cross section and the other end is in contact with an end surface of the pressing portion.

A fixing tool for an endpin according to the present invention includes an endpin including a shaft portion having one end housed in a musical instrument main body and another end stood on a floor, the shaft portion being provided with a recess, and any of the above-described main body fixing members.

A musical instrument according to the present invention uses the above-described fixing tool for an endpin.

A fastening portion according to the present invention is a fastening portion of a fixing tool for an endpin, the fixing tool including an endpin including a shaft portion having one end housed in a musical instrument main body and another end stood on a floor, the shaft portion being provided with a recess, and a main body fixing member including a fitting portion that is fixed to the musical instrument main body, a through hole through which the shaft portion of the endpin extends, and an opening that is provided on a side surface of the main body fixing member so as to be orthogonal to the through hole, and has a bottom surface. The fastening portion includes a columnar member that is slidably disposed in the opening, and is provided with a hole through which the endpin extends and an engagement protrusion that is engaged with the recess of the shaft portion, the engagement protrusion being formed on an inner surface of the hole, a biasing portion that is disposed between the bottom surface of the opening and an end surface of the columnar member, and a pressing portion that is provided on another end surface of the columnar member, and presses the shaft portion inserted into the through hole and the hole via the columnar member.

According to the main body fixing member and the fixing tool for an endpin according to the present invention, the engagement protrusion (engagement portion) biased by the biasing portion is engaged with the recess formed in the shaft portion of the endpin. When the shaft portion of the endpin is moved in an axial direction in the through hole of the main body fixing member, recesses of the shaft portion are sequentially engaged with the engagement protrusion, and a sound, a vibration, and the like are generated at the time of engagement, so that an operator can be notified. If it is known that the engagement protrusion is engaged with the recess of the shaft portion by the sound, the vibration, and the like, the shaft portion is pressed by the pressing portion having an axial center on the same plane including an axial center of the engagement protrusion, so that the pressing portion is engaged with the recess of the shaft portion without fail. Since the pressing portion is engaged with and presses the recess of the shaft portion, even if a pressing force of the pressing portion is loosened somewhat, the engagement is not easily released, and thus the shaft portion of the endpin is not displaced relative to the through hole of the main body fixing member.

BRIEF DESCRIPTION OF THE DRAWINGS

FIGS. 2A and 2B are enlarged views of a columnar member used in the fixing tool illustrated in FIG. 1, in which FIG. 2A is a plan view, and FIG. 2B is a front cross-sectional view.

FIGS. 5A to 5C are cross-sectional views of essential parts illustrating another fixing tool for an endpin according to the present invention, in which FIGS. 5A and 5B are front cross-sectional views of components illustrating the exploded fixing tool, and FIG. 5C is a front cross-sectional view illustrating the assembled fixing tool.

DETAILED DESCRIPTION

Figure 1:
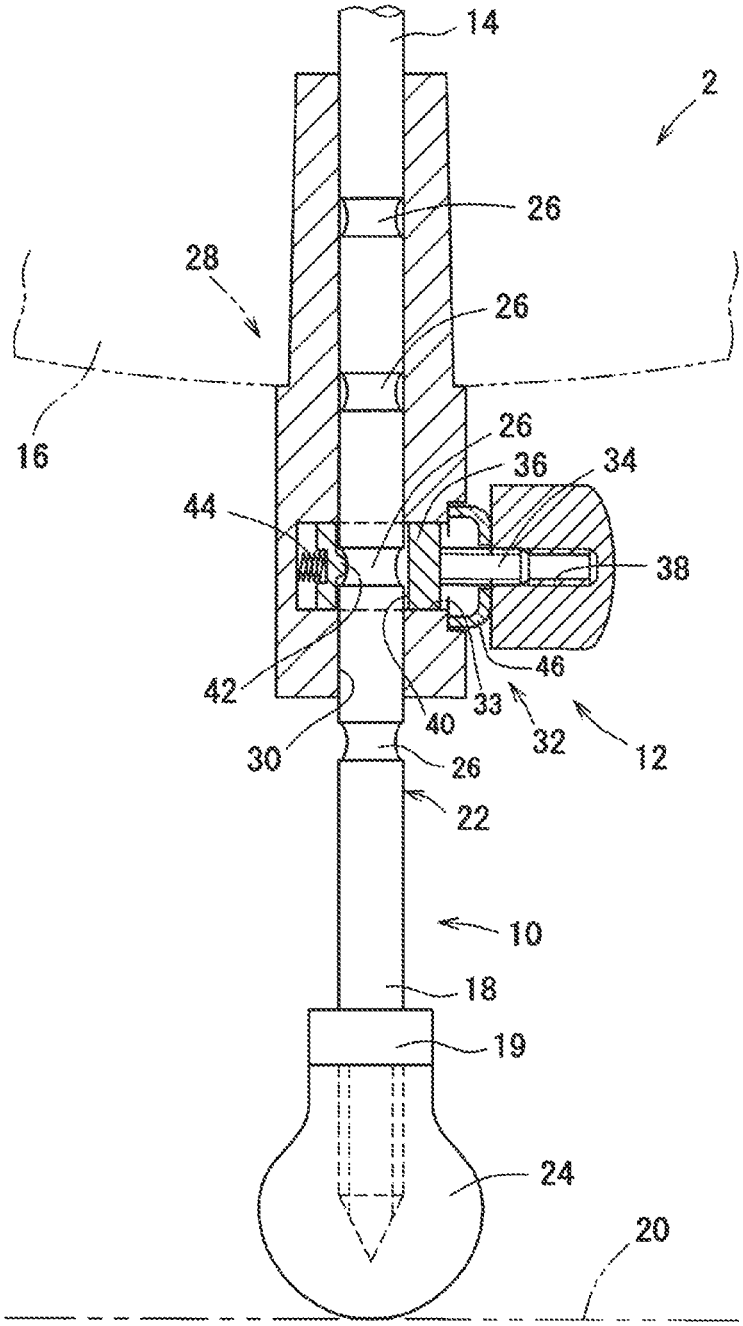
FIG. 1 is a cross-sectional view of essential parts illustrating a fixing tool for an endpin according to the present invention.

A fixing tool 2 (hereinafter referred to as a "main fixing tool") for an endpin according to the present invention includes an endpin 10 and a main body fixing member 12, as illustrated in FIG. 1.

The endpin 10 includes a shaft portion 22 having one end 14 housed in a musical instrument main body 16 and another end 18 stood on a floor 20. A rubber cap 24 is covered on a tip portion of the shaft portion 22 on a side of the other end 18. When the rubber cap 24 is removed, a pointed tip formed integrally with the shaft portion 22 appears. Usually, the endpin 10 is used with the rubber cap 24 attached when a musical instrument is performed on. In the shaft portion 22 of the endpin 10, annular recesses 26 are formed at substantially equal intervals in an axial direction. Each of the annular recesses 26 is formed in an arc shape in a circumferential direction of the shaft portion 22. That is, a central portion of each of the annular recesses 26 has the deepest recess, and both ends in the axial direction are gradually shallower and are connected to an outer diameter of the shaft portion 22. Each of the annular recesses 26 can be formed in an angular shape so as to form a groove, but a rounded shape is preferable from a viewpoint of preventing breakage due to stress concentration or the like.

A material of the shaft portion 22 of the endpin 10 is preferably steel, carbon, titanium, brass, tungsten, or the like, or a combination thereof. The material of the shaft portion 22 also has a role of transmitting vibration of a sound from the musical instrument, affects acoustic effects including sound quality, resonance, timbre, volume, and the like, depending on what kind of material is selected, and thus is appropriately selected in consideration of the effect. A length, a shaft diameter, and the like of the shaft portion 22 of the endpin 10 differ depending on a type of the musical instrument and are not limited. Shapes and intervals of the annular recesses 26 formed in the shaft portion 22 are not limited. Note that an enlarged diameter portion 19 having a diameter larger than the outer diameter of the shaft portion 22 is provided at the tip portion of the shaft portion 22 on the side of the other end 18. The enlarged diameter portion 19 is for preventing the endpin 10 from entering the inside of the musical instrument main body 16.

The main body fixing member 12 includes a fitting portion 28 that is detachably fitted to a lower portion of the musical instrument main body 16, and a through hole 30 through which the shaft portion 22 of the endpin 10 extends. An inner diameter of the through hole 30 is set to be slightly larger than the outer diameter of the shaft portion 22 of the endpin 10. An elastic member such as a cork material can be disposed on the entire surface or a part of both ends of an inner surface portion of the through hole 30. A length of the through hole 30 is only required to be long enough to support the endpin 10. A material of the main body fixing member 12 is usually wood, but the main body fixing member 12 can be formed of metal such as steel, titanium, or copper alloy. Furthermore, the main body fixing member 12 includes a fastening portion 32 that fastens the shaft portion 22 extending through the through hole 30. In the fastening portion 32, a columnar member 36 formed with a male screw 34 on an end surface is slidably inserted into an opening 33 opened in a side surface of the main body fixing member 12 so as to be orthogonal to the through hole 30, and a female screw 38 is screwed to the male screw 34. A hole 40 through which the shaft portion 22 of the endpin 10 extends is opened in side surfaces of the columnar member 36.

Figure 2A:
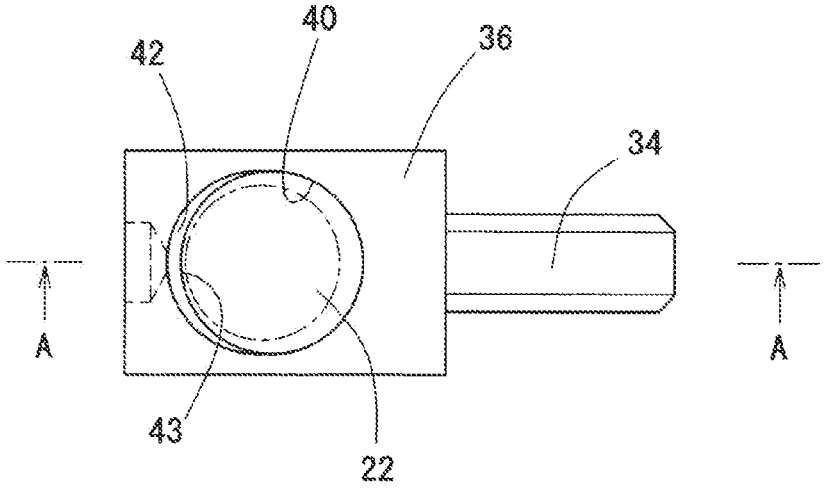
Figure 2B:
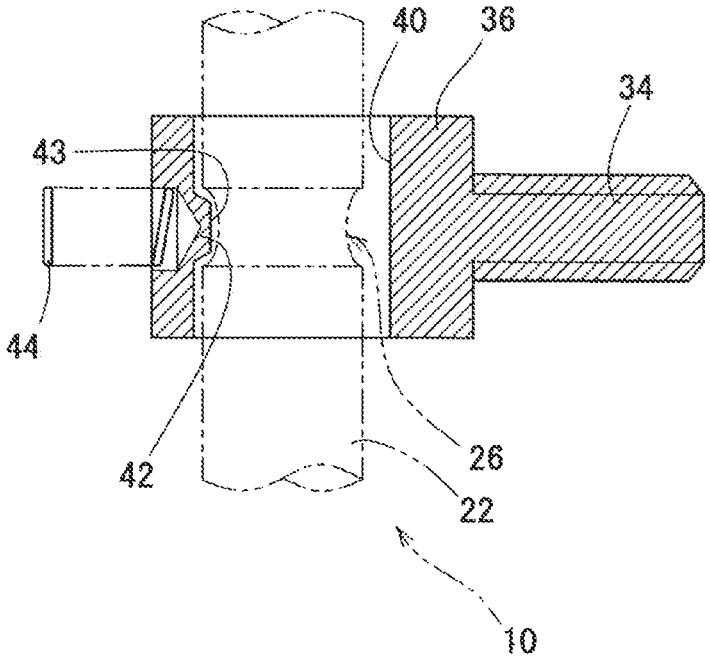

As illustrated in an enlarged manner in FIGS. 2A and 2B, an inner diameter of the hole 40 of the columnar member 36 is set to a sufficiently large inner diameter that allows the shaft portion 22 of the endpin 10 to be easily inserted. On a side surface of the hole 40 of the columnar member 36, an engagement protrusion 42 that is engaged with the annular recess 26 of the shaft portion 22 is formed on a surface opposite to the male screw 34. A shape and size of the engagement protrusion 42 are not particularly limited as long as the shape can be engaged with the annular recess 26 of the shaft portion 22. For example, the shape of the engagement protrusion 42 can be an arc shape having a radius of curvature slightly smaller than a radius of curvature of the annular recess 26 to slightly larger than the radius of curvature of the annular recess 26, or a trapezoidal shape that is fitted to the annular recess 26. When the shape of the engagement protrusion 42 is the trapezoidal shape, it is preferable that a flat surface 43 is provided at a position in contact with the shaft portion 22. It is preferable that when two corner portions of the flat surface 43 in the axial direction are engaged with the annular recess 26 of the shaft portion 22, the corner portions are in contact with an arcuate surface of the annular recess 26. This structure is adopted to eliminate axial play between the columnar member 36 and the shaft portion 22 as much as possible. Furthermore, it is preferable that a portion connecting from the flat surface 43 of the engagement protrusion 42 to an inner surface of the hole 40 in the axial direction is formed as a gentle slope. This structure is adopted for smooth movement when the shaft portion 22 of the endpin 10 and the through hole 30 are relatively moved in the axial direction. The engagement protrusion 42 can be formed on one side surface of the hole 40 of the columnar member 36 as described above, but can be provided on the entire inner surface of the hole 40 from a viewpoint of manufacturing.

On an opposite end surface of two end surfaces of the columnar member 36, where the male screw 34 is not formed, an opening in which a coil spring 44 is disposed is provided. As illustrated in FIG. 1, when the columnar member 36 is disposed in the opening 33 of the main body fixing member 12, the coil spring 44 is compressed between a bottom surface of the opening 33 and the end surface of the columnar member 36, and acts to constantly push out the columnar member 36. A coil spring having a large diameter can further be provided around the coil spring 44 to increase a biasing force. Furthermore, instead of the coil spring 44, an elastic member such as a leaf spring, a disc spring, or foam rubber can be used, and these constitute a biasing portion that biases the columnar member 36 in one direction.

The female screw 38 is screwed to the male screw 34 of the columnar member 36 via a cap 46. Therefore, in the shaft portion 22 of the endpin 10 that extends through the through hole 30 of the main body fixing member 12 and the hole 40 of the columnar member 36 inserted into the opening 33 of the main body fixing member 12, the female screw 38 is rotated and the male screw 34 is tightened, so that the columnar member 36 is attracted toward the female screw 38. As a result, the shaft portion 22 extending through the hole 40 of the columnar member 36 is attracted toward the female screw 38, but the shaft portion 22 in a part of the through hole 30 cannot move in a direction orthogonal to the axis, so that the shaft portion 22 is firmly fixed. That is, the columnar member 36, the male screw 34, and the female screw 38 constitute a pressing portion. Here, since the engagement protrusion 42 formed on the side surface of the hole 40 of the columnar member 36 is engaged with the annular recess 26 of the shaft portion 22, the shaft portion 22 does not move in the axial direction. Even if the tightening force of the female screw 38 is loosened, the shaft portion 22 of the endpin 10 does not move in the axial direction relative to the main body fixing member 12 unless the female screw 38 is loosened until the engagement protrusion 42 is disengaged from the annular recess 26, and a position of the endpin 10 relative to the main body fixing member 12 does not change.

In the above structure, the operation is as follows. First, the columnar member 36 with the coil spring 44 attached is inserted into the opening 33 of the main body fixing member 12, positions of the through hole 30 and the hole 40 of the columnar member 36 are aligned while the male screw 34 is slightly pushed, and then the shaft portion 22 of the endpin 10 is inserted into the through hole 30 and the hole 40. When a force for pushing the male screw 34 is released, the flat surface 43 of the engagement protrusion 42 formed on the side surface of the hole 40 of the columnar member 36 biased by the coil spring 44 is brought into close contact with a surface of the shaft portion 22. Since the shaft portion 22 of the endpin 10 is biased only by the biasing force of the coil spring 44, a force for fixing the shaft portion 22 is weak, and the shaft portion 22 can be slid in the axial direction relative to the through hole 30. At this time, when passing through the annular recess 26 formed in the shaft portion 22, the engagement protrusion 42 moves along the shape of the annular recess 26. As a result, vibration with a clicking sound is transmitted to an operator, and it can be seen that the engagement protrusion 42 is engaged with the annular recess 26. In this way, until the shaft portion 22 is moved to a desired position, engagement and disengagement (the engagement protrusion 42 is located at a position other than the annular recess 26 on the surface of the shaft portion 22) are observed by the sound and the vibration at the position of the annular recess 26. When the sound and the vibration are generated at the desired position, the slide of the shaft portion 22 is stopped, the female screw 38 is screwed to the male screw 34 via the cap 46, and is sufficiently tightened. Tightening and fixing is preferably performed by the engagement between the engagement protrusion 42 and the annular recess 26, but can be performed by a contact portion between the inner surface of the hole 40 of the columnar member 36 and an outer surface of the shaft portion 22 on condition that the engagement protrusion 42 is inserted into the annular recess 26.

By this operation, the engagement protrusion 42 of the columnar member 36 can be reliably engaged with the annular recess 26 of the shaft portion 22 by the sound and the vibration, and the shaft portion 22 can be sufficiently tightened and fixed at that position. Therefore, even if the female screw 38 is loosened when the musical instrument is being performed on, for example, a position of the shaft portion 22 is not displaced unless the female screw 38 is loosened until the engagement protrusion 42 and the annular recess 26 are disengaged.

Although one embodiment of the fixing tool for an endpin of the present invention has been described above in detail, the present invention is not limited to this embodiment. Next, other embodiments will be described. Note that the same parts and members as those in the above-described embodiment are designated by the same reference numerals and the description thereof will be omitted.

Figure 3:
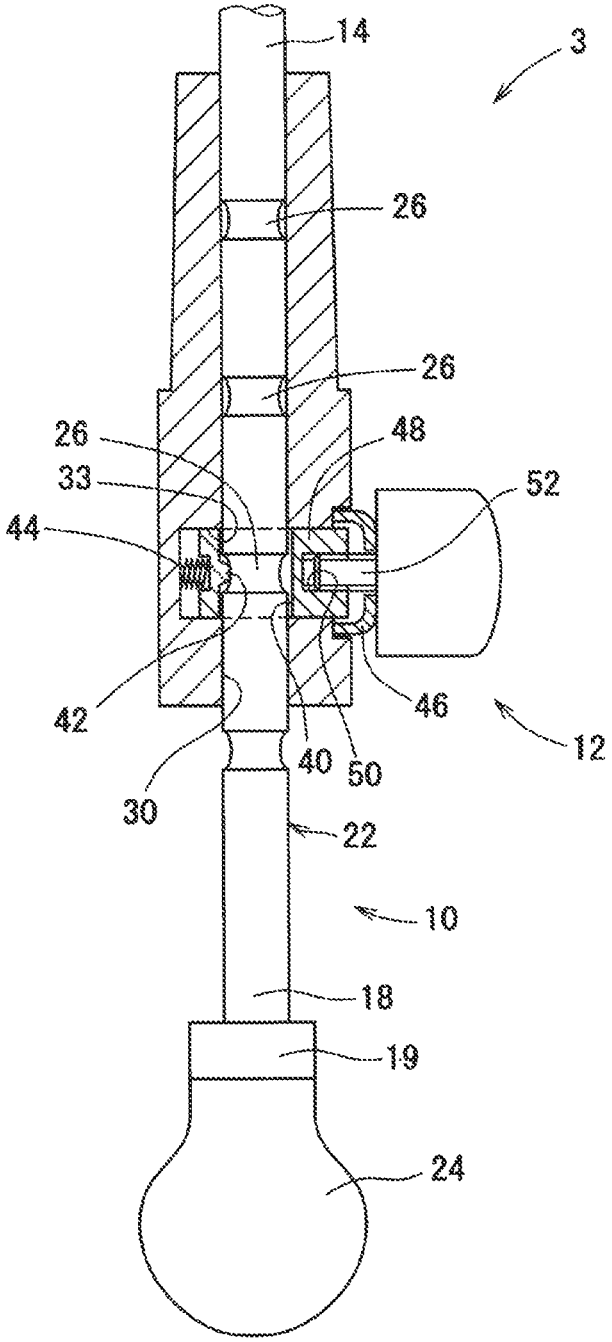
FIG. 3 is a cross-sectional view of essential parts illustrating another fixing tool for an endpin according to the present invention.

For example, as illustrated in FIG. 3, in another fixing tool 3 for an endpin according to the present invention, it is also possible to form a female screw 50 at an end portion of a columnar member 48 to be inserted into an opening 33 of a main body fixing member 12 and tighten the female screw 50 with a male screw 52. Even with such a structure, an operation and effects similar to those in the above-described embodiment can be obtained.

Figure 4:
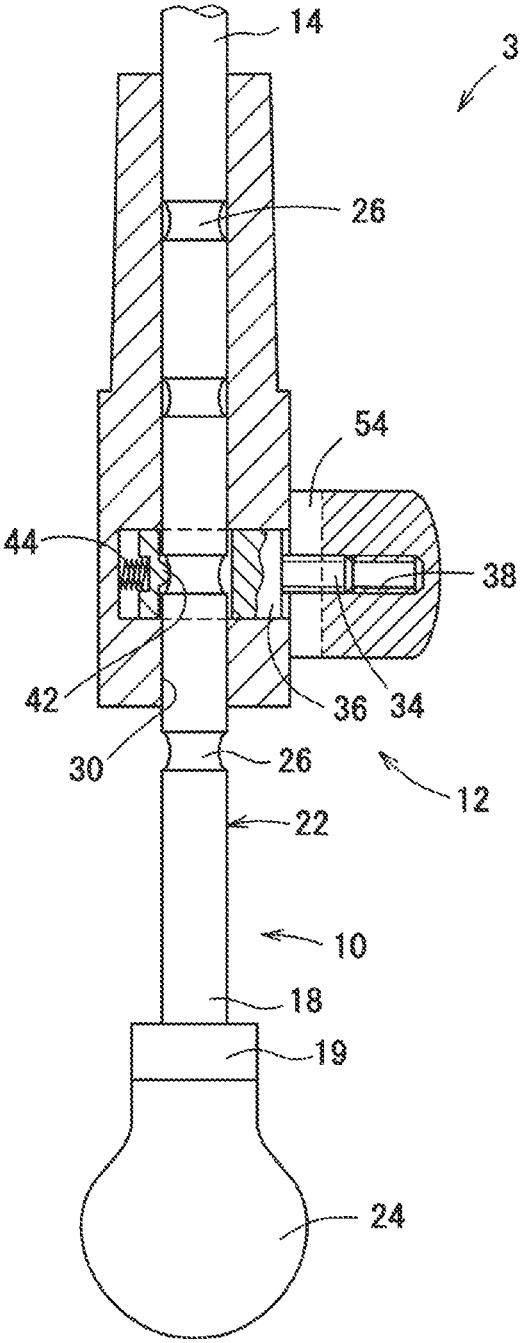
FIG. 4 is a cross-sectional view of essential parts illustrating another fixing tool for an endpin according to the present invention.

Furthermore, as illustrated in FIG. 4, in another fixing tool 3 for an endpin according to the present invention, when a male screw 34 of a columnar member 36 is tightened with a female screw 38, the female screw 38 is provided with a flange 54, so that a cap can be omitted. An outer diameter of the flange 54 is made larger than an opening 33 opened for inserting the columnar member 36. By this flange 54, a periphery of the opening 33 of a main body fixing member 12 can be pressed, the male screw 34 of the columnar member 36 can be pulled, and the opening 33 for inserting the columnar member 36 can be covered while an appearance is not spoiled. Note that, in the above-described embodiment illustrated in FIG. 3, if the male screw 52 is provided with a flange, a cap can be similarly omitted.

Next, as illustrated in FIGS. 5A to 5C, in another fixing tool 4 for an endpin according to the present invention, a main body fixing member 55 includes a fixing member main body 55A, a cover member 55B, a columnar member 36, a coil spring 44, and a male screw 52. As illustrated in FIG. 5A, the fixing member main body 55A includes a fitting portion 28 that is detachably fitted to a lower portion of a musical instrument main body, a through hole 30 through which a shaft portion 22 of an endpin 10 extends, and a hole 57 that is opened on a straight side surface opposite to the fitting portion 28 so as to be orthogonal to the through hole 30 and in which the columnar member 36 is slid. Bushings 61 made of cork, resin, or the like are fitted to both ends of the through hole 30 formed in the fixing member main body 55A, and the shaft portion 22 of the endpin 10 moves smoothly in an axial direction. A stepped portion 63 is provided at an end portion of the straight side surface of the fixing member main body 55A. Note that the fixing member main body 55A is preferably made of wood such as ebony, and the cover member 55B is preferably made of metal such as brass or stainless steel, or metal plated with gold or the like.

The columnar member 36 inserted into the hole 57 formed on the straight side surface of the fixing member main body 55A has a hole 40 through which the shaft portion 22 of the endpin 10 extends so as to penetrate side surfaces of the columnar member 36. The coil spring 44, which is a biasing portion that biases the columnar member 36 in an axial direction of the columnar member 36, is provided at one of both end portions of the columnar member 36, and a female screw 50 is formed in the other end portion in the axial direction. Furthermore, a linear or arcuate slope 65 is formed on an outer periphery of the end portion where the female screw 50 is formed. The slope 65 is for preventing the cover member 55B from being caught when the cover member 55B is covered, as described later. An engagement protrusion 42 is formed on a surface of the hole 40 that penetrates the side surfaces of the columnar member 36, on the side where the coil spring 44 is provided. A shape and the like of the engagement protrusion 42 are similar to those in the embodiment of FIG. 1, and thus the description thereof will be omitted.

The cover member 55B is covered on the straight side surface of the fixing member main body 55A and the stepped portion 63. The cover member 55B is provided with a hole 67A that covers the straight side surface of the fixing member main body 55A in the axial direction, a small diameter hole 67B that is engaged with the stepped portion 63, and a hole 67C through which the male screw 52 extends in a direction orthogonal to the axial direction. A position of the hole 67C is formed so as to be substantially coaxial with the female screw 50 of the columnar member 36 when the cover member 55B is covered on the straight side surface of the fixing member main body 55A.

In the above structure, the cover member 55B is covered on the side surface of the fixing member main body 55A so as to compress the slope 65 and an end portion of the coil spring 44 of the columnar member 36 inserted into the hole 57 of the fixing member main body 55A. The male screw 52 is then inserted via the hole 67C of the cover member 55B and lightly screwed to the female screw 50 of the columnar member 36 (see FIG. 5C). The columnar member 36 is slidably inserted into the hole 57, and an end surface of the coil spring 44 is biased by an inner surface of the hole 67A of the cover member 55B. When the columnar member 36 is biased by the coil spring 44, an axial center of the hole 40 of the columnar member 36 and an axial center of the through hole 30 are displaced from each other. In such a state, when the shaft portion 22 of the endpin 10 is inserted into the through hole 30 and the hole 40, the engagement protrusion 42 formed in the hole 40 comes into contact with the shaft portion 22 of the endpin 10 so as to be engaged with the shaft portion 22 of the endpin 10. When the engagement protrusion 42 is engaged with an annular recess 26 formed in the shaft portion 22, the male screw 52 is tightened, and the shaft portion 22 is pressed by the engagement protrusion 42 and the inner surface of the hole 40. Other actions and effects are similar to those in the embodiment of FIG. 1, and thus the description thereof will be omitted.

Figure 6:
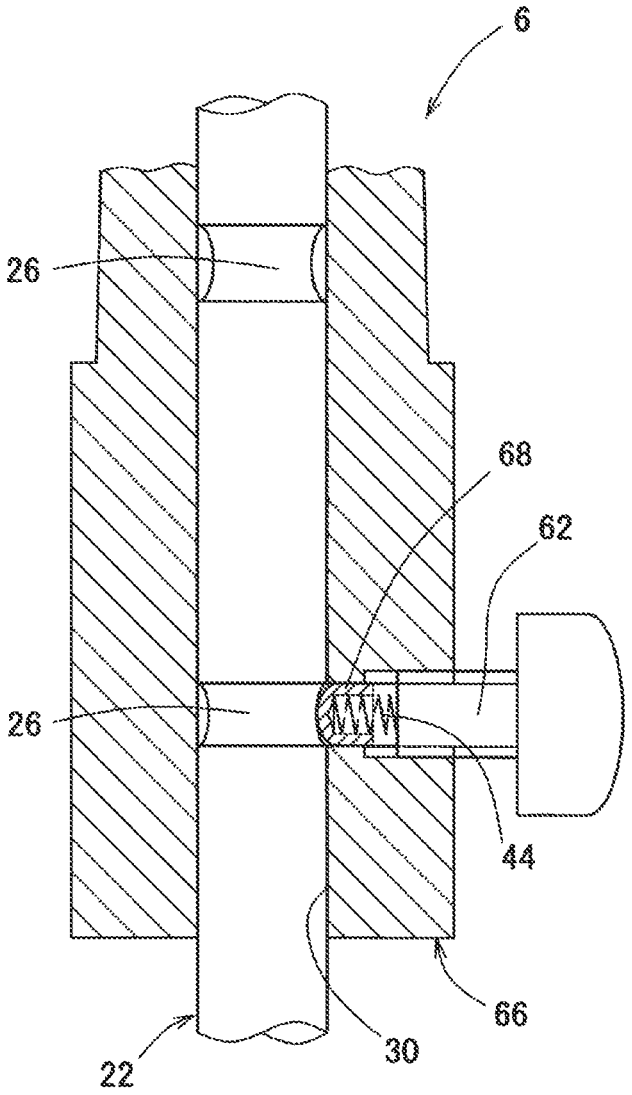
FIG. 6 is an enlarged cross-sectional view of essential parts illustrating another fixing tool for an endpin according to the present invention.
Figure 7:
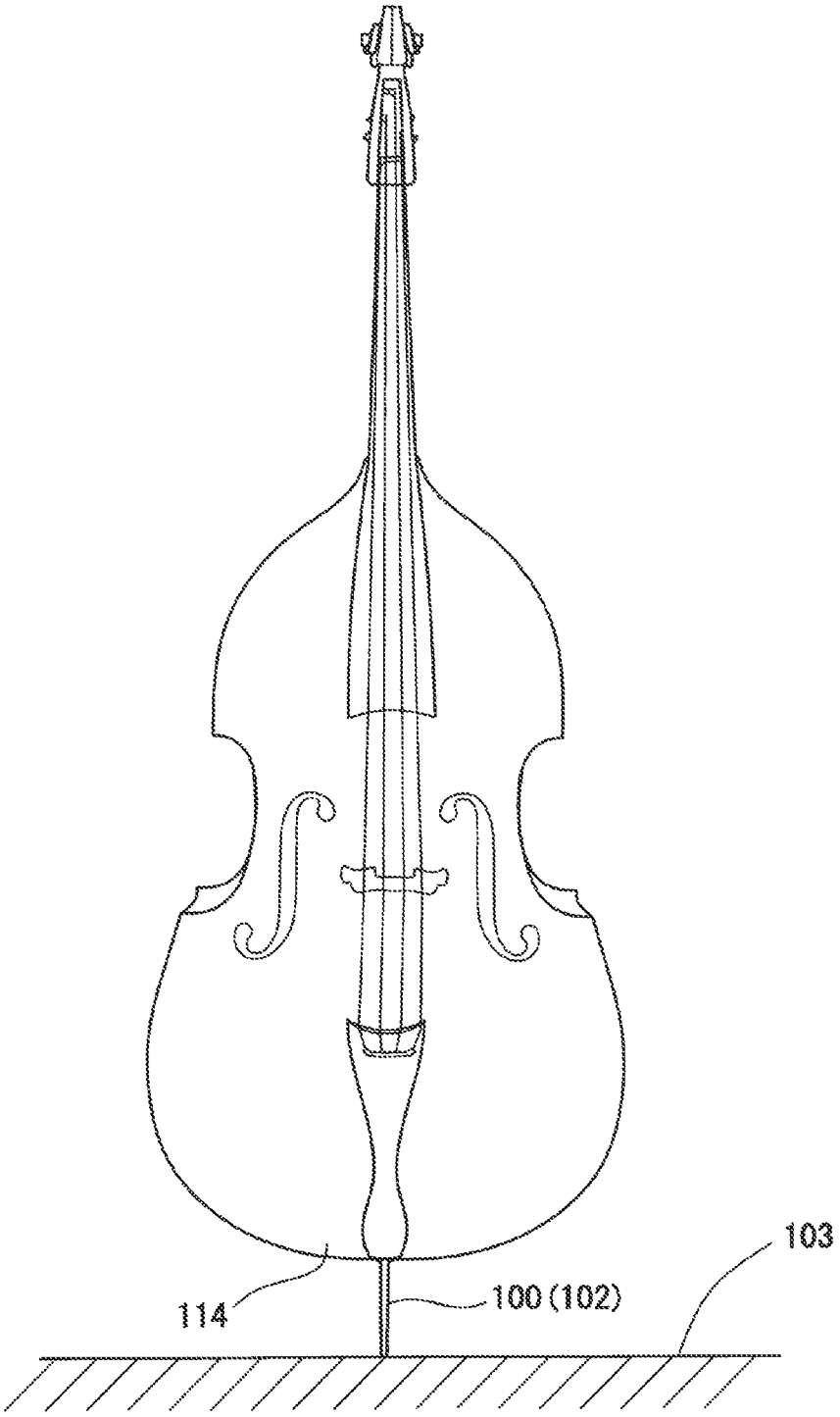
FIG. 7 is a front view illustrating an endpin attached to a contrabass.
Figure 8:
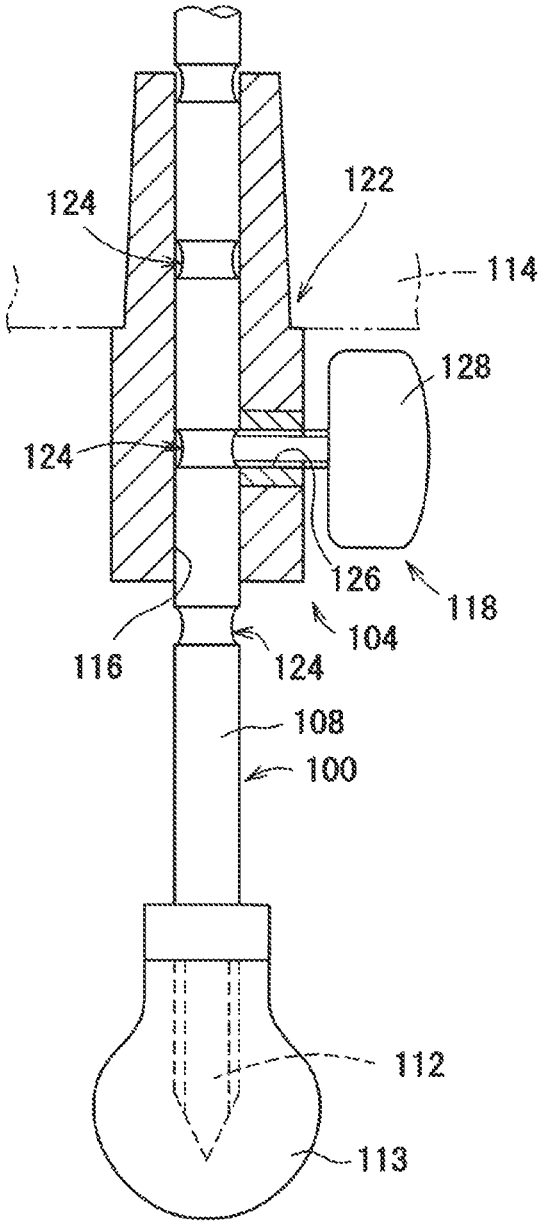
FIG. 8 is a cross-sectional view of essential parts illustrating a conventional fixing tool for an endpin.
Figure 9:
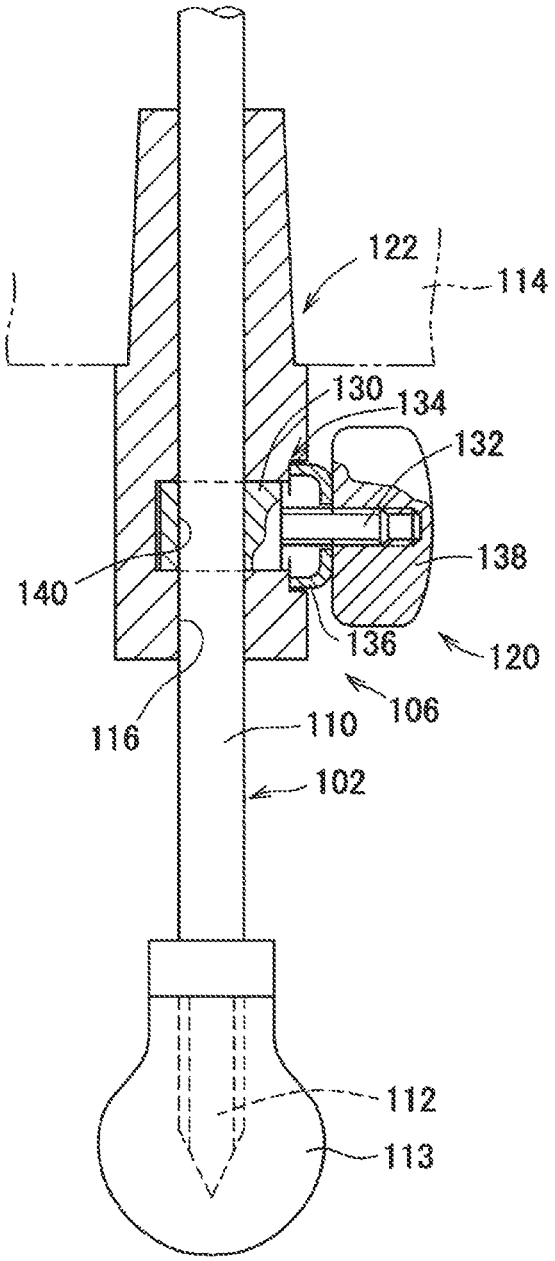
FIG. 9 is a cross-sectional view of essential parts illustrating another conventional fixing tool for an endpin.

Next, another fixing tool 6 for an endpin according to the present invention can be an embodiment illustrated in FIG. 6. That is, a female screw that reaches a through hole 30 from a side surface of a main body fixing member 66 is formed, and the female screw includes a slide member (engagement portion) 68 having a U-shaped cross section, a male screw (pressing portion) 62 that abuts against and presses an end surface of the slide member 68, and a coil spring (biasing portion) 44 disposed between the slide member 68 having a U-shaped cross section and the male screw 62. The slide member 68 having a U-shaped cross section functions as an engagement protrusion by forming a tip portion of the slide member 68 as a spherical surface along a shape of an annular recess 26 of a shaft portion 22 or a spherical surface having a radius of curvature slightly smaller than that of the annular recess 26. An opening is provided in a slide direction on the side opposite to the tip portion of the slide member 68, and the coil spring 44 is housed therein. The coil spring 44 protrudes from the opening of the slide member 68 when there is no load, and when an end portion of the coil spring 44 is pressed by the male screw 62, the coil spring 44 is housed in the opening of the slide member 68. Furthermore, when the male screw 62 is tightened, the male screw 62 presses an end surface around the opening of the slide member 68.

In the fixing tool 6, with the male screw 62 loosened, the shaft portion 22 of the endpin 10 is passed through the through hole 30 of the main body fixing member 66. The slide member 68 is pressed by the coil spring 44 and moves along a surface of the shaft portion 22. The slide member 68 is engaged at the annular recess 26 of the shaft portion 22 to generate sound and vibration. From these sound and vibration, it can be seen that the slide member 68 is located at the annular recess 26. After the shaft portion 22 is moved to a predetermined position relative to the main body fixing member 66 and it is confirmed that the slide member 68 is engaged with the annular recess 26 by the sound and the vibration, the male screw 62 is tightened and the shaft portion 22 is fixed.

Although various embodiments of the main body fixing member and the fixing tool for an endpin according to the present invention have been described above, the present invention is not limited to these embodiments. For example, the main body fixing member is usually made of wood, and in this case, when the female screw is formed on the side surface of the main body fixing member, it is preferable to embed metal in which the female screw is formed, instead of directly forming the female screw.

The shape of the annular recess formed in the shaft portion of the endpin can be formed with an inclined surface or can be a groove shape. Furthermore, the endpin can have a structure and shape suitable for the present invention, but a commercially available endpin can be used. When the commercially available endpin is used, it is not necessary to sell the endpin and the main body fixing member at the same time, and it is also possible to manufacture and sell only the main body fixing member.

It is preferable that the fixing tool for an endpin of the present invention includes the endpin and the main body fixing member and these are sold as one unit. However, since the commercially available endpin can be used, it is also possible to manufacture and sell only the main body fixing member. Furthermore, it is also possible to manufacture and sell only the fastening portion in the main body fixing member.

In addition, the present invention can be carried out in a mode in which various improvements, modifications, or changes are added based on knowledge of those skilled in the art without departing from the spirit of the present invention. Furthermore, within the scope of producing the same actions or effects, the present invention can be carried out in a mode in which any of the matters specifying the invention is replaced with another technique.

REFERENCE SIGNS LIST

2, 3, 4, 6 Fixing tool
10 Endpin
12, 55, 66 Main body fixing member
22 Shaft portion
26 Annular recess (recess)
28 Fitting portion
30 Through hole

32 Fastening portion
34, 52 Male screw (pressing portion)
36, 48 Columnar member
40 Hole
42 Engagement protrusion (engagement portion)
44 Coil spring (biasing portion)

The invention claimed is:

1. A main body fixing member that fixes an endpin including a shaft portion having a first end housed in a musical instrument main body and a second end stood on a floor, the shaft portion being provided with a recess, the main body fixing member comprising:

a fitting portion fixed to the musical instrument main body;

a through hole through which the shaft portion of the endpin extends;

an opening provided on a side surface of the main body fixing member to be orthogonal to the through hole, the opening having a bottom surface;

a columnar member slidably disposed in the opening, and provided with a hole through which the shaft portion extends and an engagement protrusion engaged with the recess of the shaft portion, the engagement protrusion being formed on an inner surface of the hole;

a biasing portion disposed between the bottom surface of the opening and a first end surface of the columnar member; and a pressing portion provided on a second end surface of the columnar member, the pressing portion being configured to press the shaft portion inserted into the through hole and the hole via the columnar member.

2. A main body fixing member that fixes an endpin including a shaft portion having a first end housed in a musical instrument main body and a second end stood on a floor, the shaft portion being provided with a recess, the main body fixing member comprising:

a fitting portion fixed to the musical instrument main body;

a through hole through which the shaft portion of the endpin extends;

a lateral through hole provided on a side surface of the main body fixing member to be orthogonal to the through hole;

a columnar member slidably disposed in the lateral through hole, and provided with a hole through which the shaft portion extends and an engagement protrusion engaged with the recess of the shaft portion, the engagement protrusion being formed on an inner surface of the hole;

a cover member that covers the lateral through hole;

a biasing portion disposed between an inner surface of the cover member and a first end surface of the columnar member; and a pressing portion provided on a second end surface of the columnar member, the pressing portion being configured to press the shaft portion inserted into the through hole and the hole via the columnar member.

3. A main body fixing member that fixes an endpin including a shaft portion having a first end housed in a musical instrument main body and a second end stood on a floor, the shaft portion being provided with a recess, the main body fixing member comprising:

a fitting portion fixed to the musical instrument main body;

a through hole through which the shaft portion of the endpin extends;

a female screw provided on a side surface of the main body fixing member so as to reach the through hole;

an engagement portion that has a U-shaped cross section and is inserted into the female screw;

a pressing portion screwed to the female screw and configured to abut against an end surface of the engagement portion to press the shaft portion via the engagement portion; and a biasing portion in which a first end is housed in an opening provided in the engagement portion having a U-shaped cross section and a second end is in contact with an end surface of the pressing portion.

4. A fixing tool for an endpin, the fixing tool comprising:

an endpin including a shaft portion having a first end housed in a musical instrument main body and a second end stood on a floor, the shaft portion being provided with a recess; and the main body fixing member according to claim 1.

5. A musical instrument using the fixing tool for an endpin according to claim 4.

6. A fastening portion of a fixing tool for an endpin, the fixing tool including an endpin including a shaft portion having a first end housed in a musical instrument main body and a second end stood on a floor, the shaft portion being provided with a recess, and a main body fixing member including a fitting portion fixed to the musical instrument main body, a through hole through which the shaft portion of the endpin extends, and an opening provided on a side surface of the main body fixing member to be orthogonal to the through hole, the opening having a bottom surface, the fastening portion comprising:

a columnar member slidably disposed in the opening, and provided with a hole through which the endpin extends and an engagement protrusion engaged with the recess of the shaft portion, the engagement protrusion being formed on an inner surface of the hole;

a biasing portion disposed between the bottom surface of the opening and a first end surface of the columnar member; and a pressing portion provided on a second end surface of the columnar member, the pressing portion being configured to press the shaft portion inserted into the through hole and the hole via the columnar member.

7. A fixing tool for an endpin, the fixing tool comprising:

an endpin including a shaft portion having a first end housed in a musical instrument main body and a second end stood on a floor, the shaft portion being provided with a recess; and the main body fixing member according to claim 2.

8. A fixing tool for an endpin, the fixing tool comprising:

an endpin including a shaft portion having a first end housed in a musical instrument main body and a second end stood on a floor, the shaft portion being provided with a recess; and the main body fixing member according to claim 3.

9. A musical instrument using the fixing tool for an endpin according to claim 7.

10. A musical instrument using the fixing tool for an endpin according to claim 8.

* * * * *